US007213434B2

(12) United States Patent
Sato

(10) Patent No.: US 7,213,434 B2
(45) Date of Patent: May 8, 2007

(54) METHOD FOR MANUFACTURING UNIVERSAL JOINT YOKE, FORGING DIE AND PREFORM

(75) Inventor: Masahiro Sato, Kitakata (JP)

(73) Assignee: Showa Denko K.K, Tokyo (JP)

( * ) Notice: Subject to any disclaimer, the term of this patent is extended or adjusted under 35 U.S.C. 154(b) by 55 days.

(21) Appl. No.: 10/500,105

(22) PCT Filed: Dec. 25, 2002

(86) PCT No.: PCT/JP02/13524

§ 371 (c)(1),
(2), (4) Date: Feb. 14, 2005

(87) PCT Pub. No.: WO03/055620

PCT Pub. Date: Jul. 10, 2003

(65) Prior Publication Data

US 2005/0115296 A1 Jun. 2, 2005

Related U.S. Application Data

(60) Provisional application No. 60/343,171, filed on Dec. 31, 2001.

(30) Foreign Application Priority Data

Dec. 26, 2001 (JP) ..... 2001-395510

(51) Int. Cl.
*B21J 13/00* (2006.01)
*B21D 22/00* (2006.01)

(52) U.S. Cl. ..... 72/354.8; 72/359

(58) Field of Classification Search ..... 72/354.6, 72/354.8, 353.2, 352, 377, 355.2, 355.6, 72/267, 358, 359; 29/894.362
See application file for complete search history.

(56) References Cited

U.S. PATENT DOCUMENTS 1,410,093 A * 3/1922 Dallmeyer et al. .... 29/894.362
3,072,251 A * 1/1963 Sauve ..... 72/42
4,094,183 A * 6/1978 Mettler ..... 72/377
4,304,115 A 12/1981 Martin
5,601,377 A * 2/1997 Ohya ..... 72/377
2002/0092168 A1 7/2002 Iihara et al.

FOREIGN PATENT DOCUMENTS

GB 940467 A 10/1963
JP 2000-263178 A 9/2000

OTHER PUBLICATIONS

Patent Abstracts of Japan vol. 005, No. 029 (M-056) Feb. 21, 1981, abstracting JP 55-156632 of Dec. 5, 1980.
Patent Abstracts of Japan vol. 005, No. 029 (M-056) Feb. 21, 1981, abstracting JP 55-156631 of Dec. 5, 1980.

* cited by examiner

*Primary Examiner*—Lowell A. Larson
*Assistant Examiner*—Teresa M. Bonk
(74) *Attorney, Agent, or Firm*—Sughrue Mion, PLLC

(57) ABSTRACT

A method for manufacturing a universal joint yoke that exhibits good yield in terms of material utilization through obtainment of a universal joint yoke perform whose excess metal to be trimmed is diminished and whose cup portion is of uniform height, includes a forging step for forming a universal joint yoke preform from a workpiece 6 placed in a die including an upper die 103 and a lower die 65 which are to define a closed space. The forging step is performed such that, while a back pressure not lower than 0.5 kg/mm$^2$ is applied to an end of a prospective universal joint yoke cup portion 41 of the workpiece via a ring knock 67, material of the workpiece is allowed to flow into a pin-boss-forming cavity adapted to form a pin boss portion extending opposite the prospective cup portion until a filling rate not lower than 75 % is reached, and that the ring knock is then moved in a direction opposite a regular forming direction of the upper or lower die in which the ring knock is disposed so as to initiate flow of the workpiece material toward the prospective cup portion.

9 Claims, 13 Drawing Sheets

PRIOR ART

PRIOR ART

PRIOR ART

METHOD FOR MANUFACTURING UNIVERSAL JOINT YOKE, FORGING DIE AND PREFORM

CROSS REFERENCE TO RELATED APPLICATIONS

This application is an application filed under 35 U.S.C. § 111(a) claiming the benefit pursuant to 35 U.S.C. § 119(e)(1) of the filing date of Provisional Application No. 60/343,171 filed Dec. 31, 2001 pursuant to 35 U.S.C. § 111(b).

TECHNICAL FIELD

The present invention relates to a method for manufacturing a universal joint yoke having a thin-walled cup portion, to a forging die for use in the method and to a preform forged with the die.

BACKGROUND ART

An example of a component having a thin-walled cup portion is a universal joint yoke for use in a propeller shaft of a power train system. FIG. 12 schematically shows a propeller shaft. The propeller shaft connects the outlet of a transmission (111) and a final drive (119) in a power transmission system and uses universal joints at connections of shafts thereof. The universal joints each include a yoke (112*a*, 112*b* or 112*c*) and a cross member (113*a*, 113*b* or 113*c*) and are adapted to transmit rotation as power to shafts (114*a* and 114*b*) connected thereto. Denoted by reference numeral 116 is a metal fitting that mounts the propeller shaft on a body 117, and by numeral 115 is a bearing for angle change.

Universal joint yokes have been manufactured from an extruded aluminum alloy by means of cold forging. FIG. 13 shows an example of a die configuration for use in a conventional cold forging process. FIG. 16 exemplifies an as-forged article with flash that is obtained by a conventional flash-emerging forging process (FIG. 16(*a*)), and a yoke that is obtained by trimming the flash (FIG. 16(*b*)).

In FIG. 13, an upper die 2 supported on an upper bolster 1 gives an aluminum workpiece a shape corresponding to a cup portion of a universal joint yoke to be connected to a shaft, and a lower die 4 on a lower bolster 5 gives the aluminum workpiece a shape corresponding to a pin boss portion to be coupled to a cross member. The upper die 2 descends toward the lower die 4 to press an aluminum workpiece 6 therebetween, whereby the shapes of the upper and lower dies are transferred to the workpiece by means of a space that is defined by the upper and lower dies. The aluminum workpiece placed in the lower die is lubricated beforehand and is not preheated. FIG. 14 shows the die configuration for use in the conventional cold forging as viewed at the forging completion stage where the upper die is positioned at the bottom dead center of its stroke. A cup portion of an as-forged article 7 formed on the side toward the upper die is formed through free-end forging not involving restraint by the upper die. Reference numeral 3 denotes a stopper.

As shown in FIG. 16(*a*), the as-forged article 7 obtained by the conventional process involves an uneven height of an excess metal end for the following reason. Since a cup portion 41 is formed through free-end forging, workpiece material undergoes plastic flow such that much more workpiece material flows toward a pin boss portion 43, so that workpiece material that flows toward the cup portion 41, which is located axially opposite the pin boss portion 43, is diminished. As a result, the quantity of cutting increases, resulting in a decrease in yield in terms of material utilization.

As shown in FIG. 14, in the conventional forging process, forging starts upon the upper die contacting the workpiece, and the outer circumferential portion of the upper die and the inner circumferential portion of the lower die do not come into contact during the course of forging. A pin boss portion is irregularly shaped because of the difference in amount of the material flowing into the cavity of the lower die. This irregular shape of the pin boss portion causes deflection of the upper die during the course of forging. As a result, concentricity becomes about 1 mm between the inner cylindrical wall of a cup portion, which is formed by means of the upper die, and the outer cylindrical wall of the cup portion, which is formed by means of the lower die. Therefore, in the subsequent machining step, the wall thickness of the cup portion is finished uneven. In some cases, the resultant yoke may exhibit insufficient coupling strength in coupling to a shaft.

In the conventional forging process, since the occurrence of underfill on a cup portion is unavoidable, a large wall thickness is imparted to the cup portion. Also, in order to obtain a cutting allowance, excess metal is intentionally added even though the height of an excess metal end becomes uneven. Therefore, poor yield in terms of material utilization results. Also, a height variation of a cup end of an as-forged article is not less than 25 mm, which is in excess of a preferred value of 10 mm.

In order to reduce a cutting allowance through attainment of a uniform height of a cup portion, a closed forging process has been devised. However, in some cases, the closed forging process has involved the following problem. Since the volume of a pin boss portion accounts for a great portion of the entire yoke volume in the course of plastic flow of workpiece material toward a pin-boss-forming cavity, plastic flow of workpiece material is not initiated toward a portion of a cup-forming cavity that is located axially opposite the pin-boss-forming cavity. Therefore, in some cases, there has arisen a problem of underfill in a corresponding region of a cup portion, which is a coupling portion to a shaft. Also, since plastic flow of workpiece material to a portion of the cup-forming cavity that does not have a counter pin-boss-forming cavity occurs preferentially, filling of the portion of the cup-forming cavity is completed at an early stage. Thus, a die load increases, thereby shortening the life of a portion of the die that corresponds to the portion of the cup-forming cavity of early completion of filling. Therefore, the conventional closed forging process is not practical.

In order to solve the above-mentioned problem, multi-stage forging was proposed. Specifically, first a pin boss is formed, and then a cup is formed. FIG. 15 shows a die for use in a conventional multi-stage forging process. An upper die 31 supported on a bolster 1 and a lower die 32 disposed on a bolster 5 shown in FIG. 15(*a*) are used to forge a perform 34 with a pin boss portion. The perform is then forged into a perform with both the pin boss portion and a cup portion using an upper die 2 and a lower die 4 shown in FIG. 15(*b*). Reference numeral 33 denotes a knockout pin, and numeral 3 a stopper. This process requires dies for use at individual stages and involves a plurality of forging stages, resulting in low productivity and high cost.

Such multi-stage forging requires a plurality of dies and thus involves high die cost. Further, since plural stages are involved, productivity decreases. Therefore, multi-stage forging is not practical. Also, as mentioned previously, single-stage forging involves a heavy forging load and thus requires a forging press of a large forging capacity. Further, an increase in die load shortens the life of a die. Thus, demand exists for a single-stage forging process with enhanced productivity.

JP-A No. 2000-263178 discloses a method for forming a uniform-height cup-shaped article of brass. According to this method, first a workpiece is formed into a cup shape, and subsequently a separately driven ram presses the cup-shaped workpiece from above to form an undercut on the workpiece. The method disclosed in the publication uses a workpiece of brass. Since brass is readily susceptible to plastic flow, a workpiece of brass can be formed under the disclosed conditions. However, because of high resistance to deformation at high temperature, an aluminum alloy is less susceptible to plastic flow as compared with brass and thus cannot be formed under the disclosed conditions.

The present invention has been achieved in view of the foregoing, and an object of the invention is to provide a method for manufacturing a universal joint yoke which exhibits good yield in terms of material utilization through obtainment of a universal joint yoke preform whose shape is close to that of a finished product, whose excess metal to be trimmed is diminished, and whose cup portion is of uniform height.

DISCLOSURE OF THE INVENTION

The present invention provides a method for manufacturing a universal joint yoke, comprising a forging step for forming a universal joint yoke preform from a workpiece placed in a die comprising an upper die 103 and a lower die 65, which are to define a closed space, the forging step being performed such that while back pressure not lower than 0.5 kg/mm$^2$ is applied to an end of a prospective universal joint yoke cup portion of the workpiece via a ring knock 67, material of the workpiece is allowed to flow into a pin-boss-forming cavity of the lower die adapted to form a pin boss portion extending opposite the prospective cup portion until a filling rate not lower than 75% is reached, and that the ring knock is then moved in a direction opposite a regular forming direction of the upper or lower die, in which the ring knock is disposed, so as to initiate flow of the workpiece material toward the prospective cup portion.

In the manufacturing method, the back pressure increases as the ring knock moves in the opposite direction, and the final back pressure is 1.2 to 2.2 times the initial back pressure.

In the manufacturing method, the back pressure is generated by means of a gas cushion or spring.

In the manufacturing method, back pressure of 1.5 to 25 kg/mm$^2$ is initially applied, and then, while the back pressure is held at a value of 0.5 to 20 kg/mm$^2$ that is lower than the initially applied value, the workpiece material is allowed to flow into the pin-boss-forming cavity until a filling rate not lower than 90% is reached, followed by movement of the ring knock.

In the manufacturing method, the back pressure is generated by means of a hydraulic cushion in place of or in addition to the gas cushion.

In the manufacturing method, the back pressure can be generated by at least two means selected from a gas cushion, a spring and a hydraulic cushion.

In the manufacturing method, the workpiece is of an aluminum alloy selected from among A6061, A6082, A2014, A2017, A4032 and A7075.

In the manufacturing method, the workpiece is formed by the steps of cutting a round bar of an aluminum alloy into pieces each having a predetermined length and upsetting each of the pieces, and further comprising the steps of heat-treating an as-forged article and machining the heat-treated article.

In the manufacturing method, the machining step to be performed after the forging step does not involve a step of trimming a parting-line flash of the as-forged article.

The present invention further provides a forging die for use in forging a universal joint yoke preform, comprising an upper die 103 and a lower die 65 which are to define a closed space, a ring knock 67, a knockout pin 64, a die holder, back pressure generation means for generating back pressure not lower than 0.5 kg/mm$^2$ to be applied to the ring knock, and a pressure-bearing plate on which the upper or lower die and the back pressure generation means are disposed.

In the forging die, the back pressure generation means comprises at least one of a gas cushion and a hydraulic cushion.

The present invention further provides a universal joint yoke preform manufactured by any one of the manufacturing methods, wherein a height variation of the prospective cup portion 41 is not greater than 8 mm.

The present invention further provides a universal joint yoke having a cup portion, a pin boss portion and a parting-line portion that bears no trimming mark, and exhibiting a ratio of a crystal grain average length as measured at (41*b*) to a crystal grain average length as measured at (41*a*), which ratio is 0.5 to 1.5, wherein the ( 41*a*) is an end region of the cup portion, opposite to which no pin boss portion exists, and the (41*b*) is an end region of the cup portion, opposite to which the pin boss portion exists.

The universal joint yoke can be produced using the aforementioned universal joint yoke perform.

Herein, 1 kg/mm$^2$ is equal to 9.8 MPa (conversion factor).

BEST MODES FOR CARRYING OUT THE INVENTION

An embodiment of the present invention will next be described.

Figure 5:
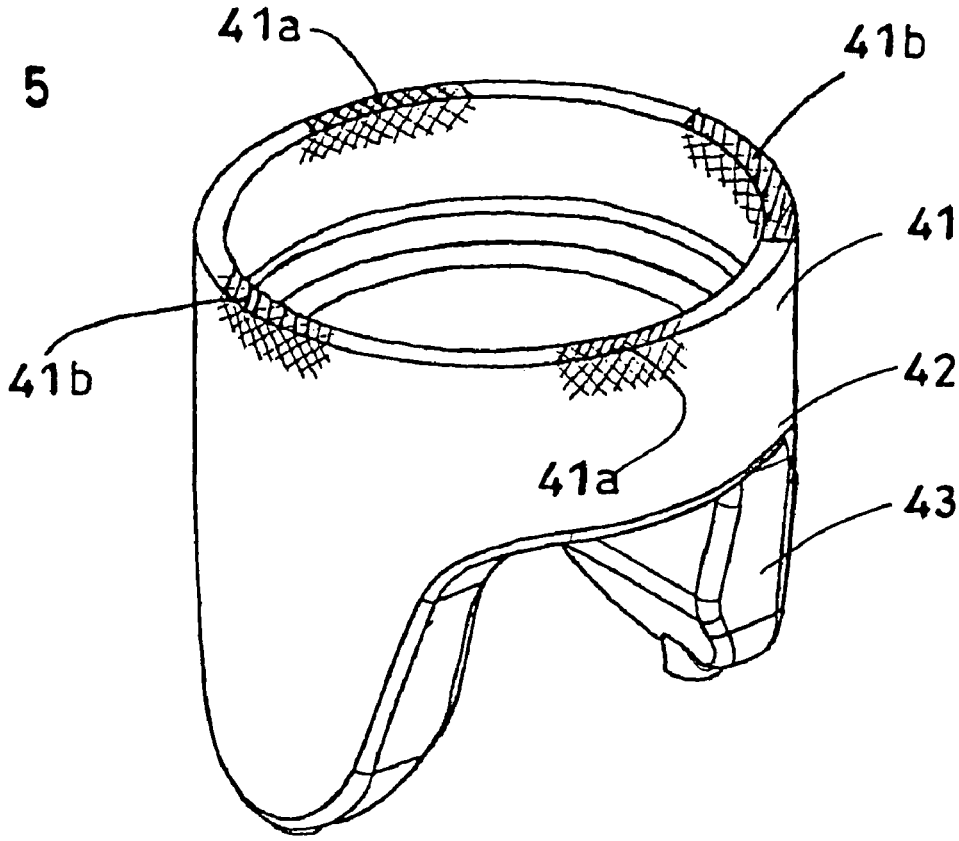
FIG. 5 is a sketch showing an as-forged yoke preform of the present invention.

FIG. 5 shows an example of a universal joint yoke (hereinafter also referred to as a "yoke") preform. The preform is composed of at least a coupling portion (cup portion) 41 to be coupled to a shaft, a pin boss portion 43, and a plate portion 42. These portions are machined to their respective final shapes as needed.

Figure 6:
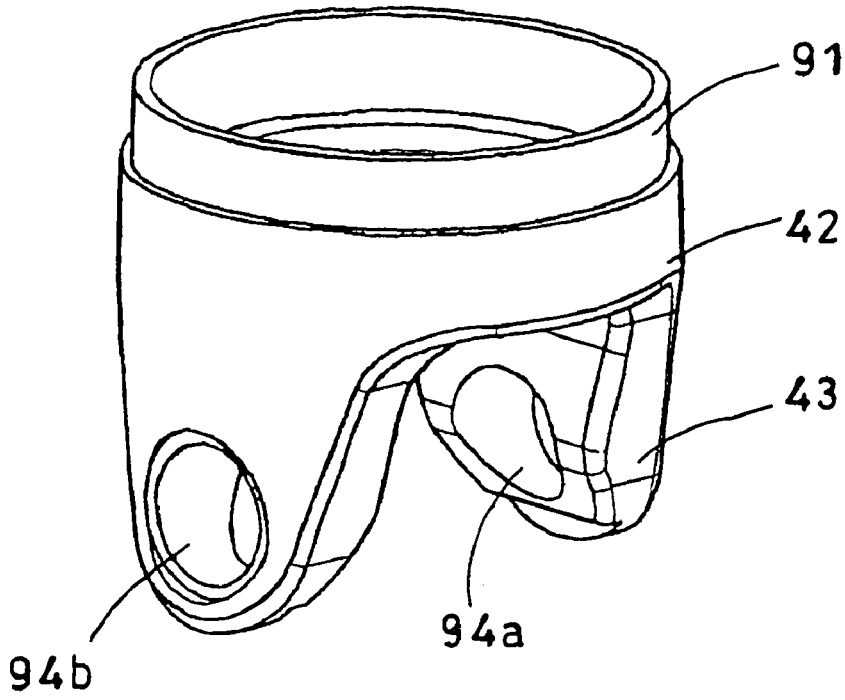
FIG. 6 is a sketch showing a finished yoke obtained by machining the preform.

FIG. 6 shows an example of a universal joint yoke of the present invention. The universal joint yoke is obtained by means of machining the preform of FIG. 5. The universal joint yoke of the present invention is composed of at least a coupling portion (cup portion) 91 to be coupled to a shaft, a pin boss portion 43, pinholes 94*a* and 94*b* and a plate portion 42.

Figure 12:
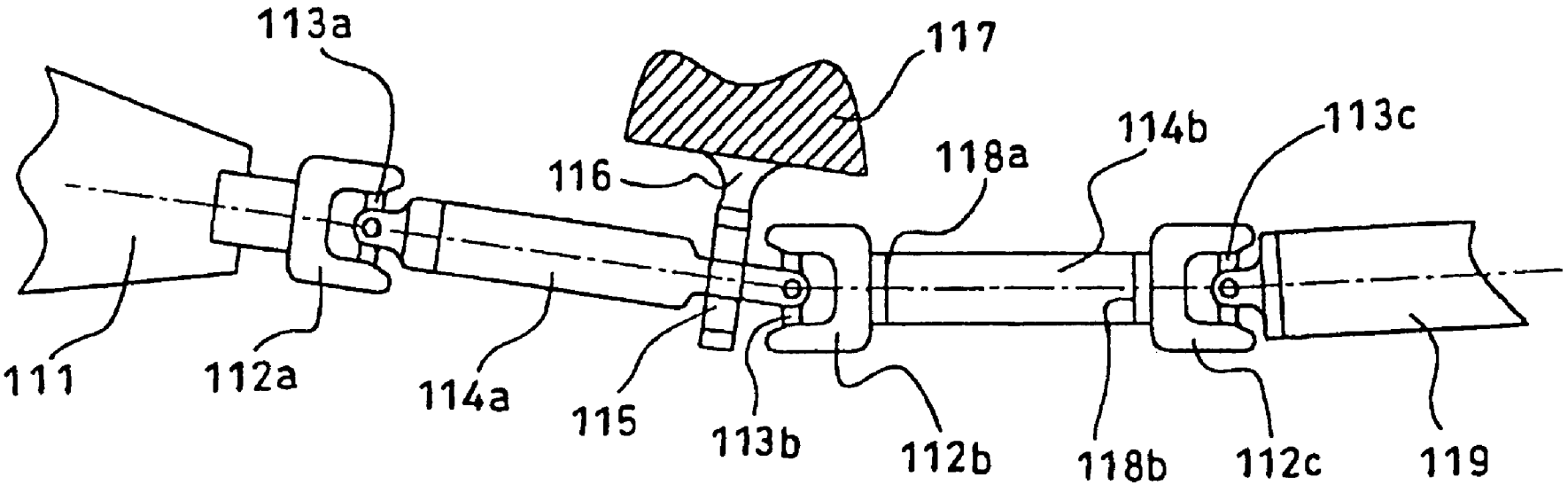
FIG. 12 is a schematic representation showing a propeller shaft (i.e., drive shaft).
Figure 13:
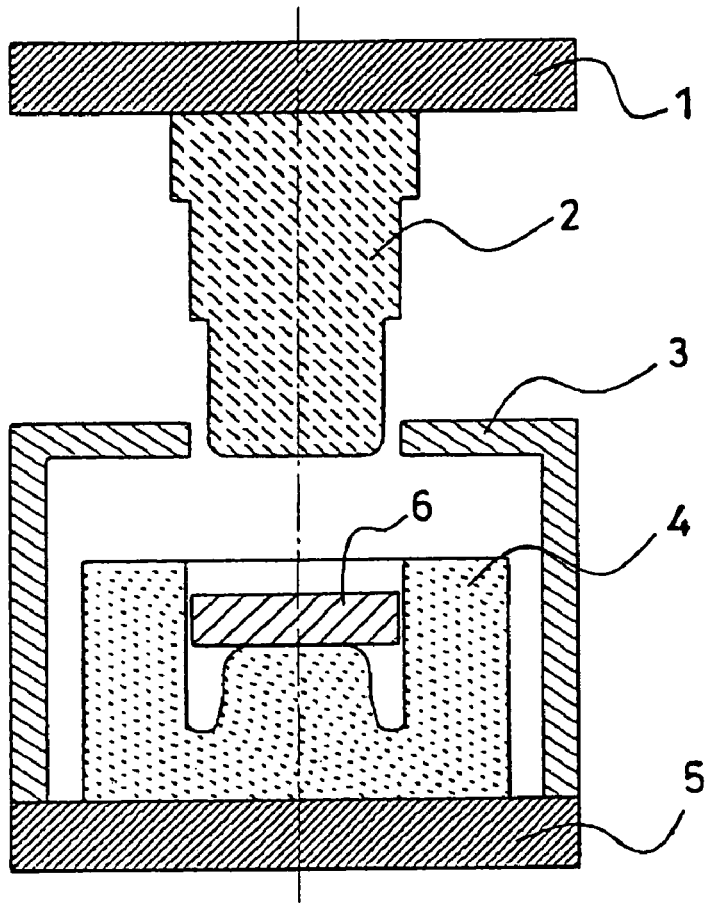
FIG. 13 PRIOR ART
FIG. 13 is a schematic sectional view showing a die configuration of a conventional forging process (top dead center).
Figure 14:
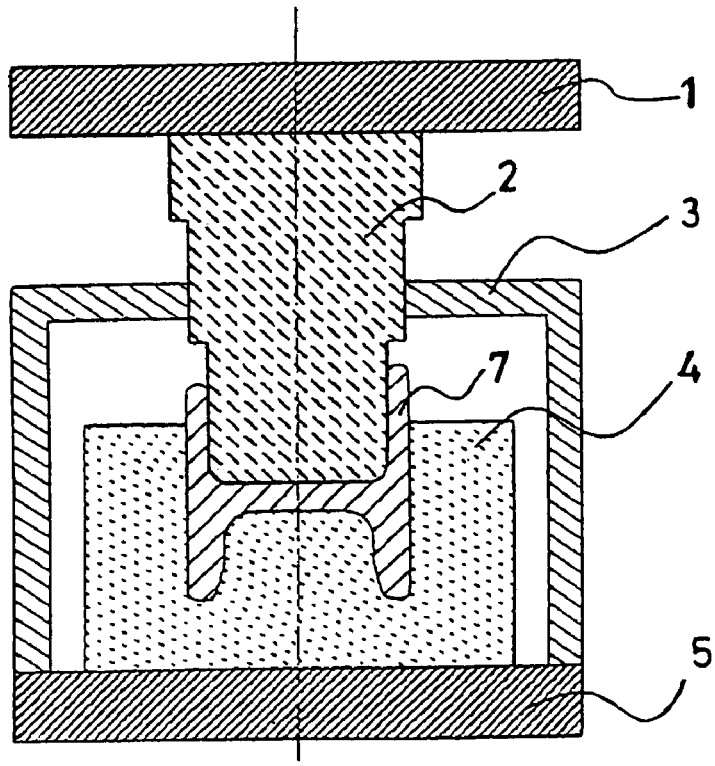
FIG. 14 PRIOR ART
FIG. 14 is a schematic sectional view showing a die configuration of the conventional forging process (bottom dead center).
Figure 15A:
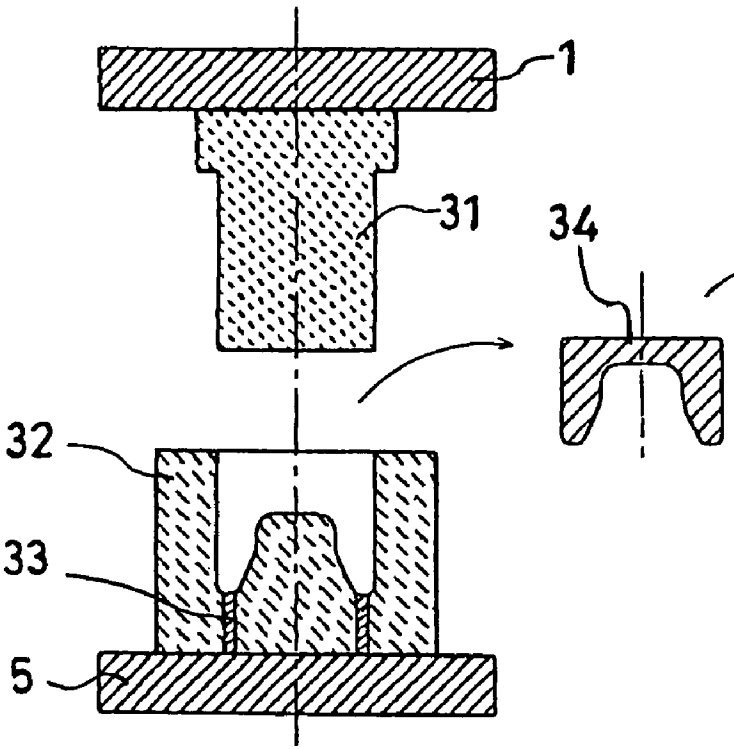
FIG. 15 is a schematic representation showing a conventional two-stage forging process, FIG. 15(*a*) showing a die configuration for forming a pin boss portion and FIG. 15(*b*) showing a die configuration for forming a cup portion.
Figure 15B:
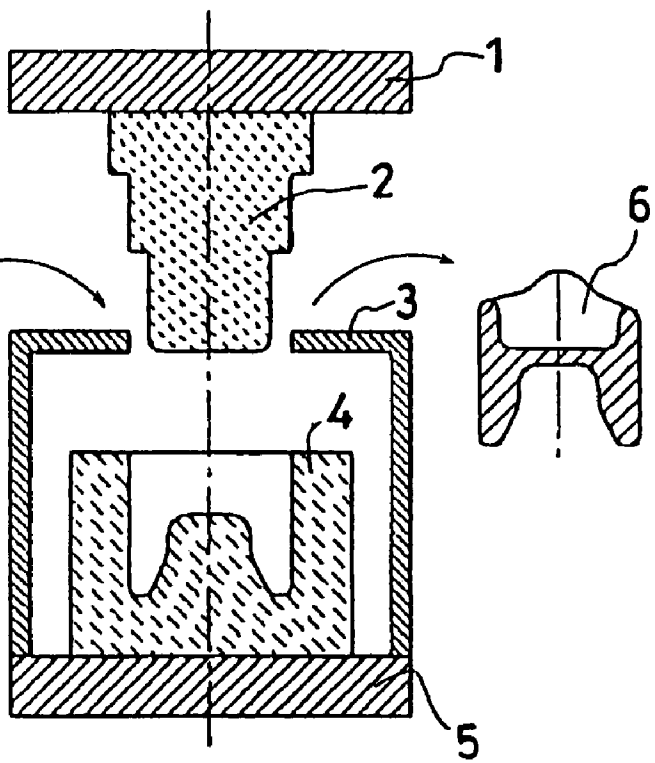
PRIOR ART FIG. 15(b)

A configuration example of a power train system, in which universal joint yokes of FIG. 6 are incorporated, will be described specifically with reference to FIG. 12. Reference numeral 112 denotes a yoke, which has pinholes 94*a* and 94*b* formed in a pin boss portion 43. The pinholes 94*a* and 94*b* are formed by means of machining and serve as coupling portions to a cross member. Referring to FIG. 12, in which a portion of the power train system is omitted, yokes are used in pairs such that one yoke is coupled to its counterpart via a cross member 113, which is fitted into the pinholes formed in the paired yokes. The inside diameter of a cup portion 91 is finished by means of machining according to the diameter of a shaft 114. The cup portion 91 is joined to the shaft 114 by means of, for example, arc welding, such as MIG welding (Metal Inert Gas arc welding) or TIG welding (Tungsten Inert Gas arc welding), friction welding or friction stir welding.

A configuration example of a forging apparatus for use in manufacturing a universal joint yoke according to the present invention will be described with reference to FIG. 8.

The forging apparatus includes a forging press 221, an upper die 103 and a lower die 105. A pneumatic cylinder 231, which serves as back pressure generation means, is incorporated in an upper portion of the upper die. A knock-out pin for ejecting an as-forged article is disposed in the lower die. Reference numeral 108 denotes a spray-moving unit, numeral 109 a spray-rotating unit and numeral 110 a spray shaft. A spray nozzle 104 is supported by the spray-rotating unit and the spray-moving unit via the spray shaft and adapted to spray lubricant on the die.

Figure 4:
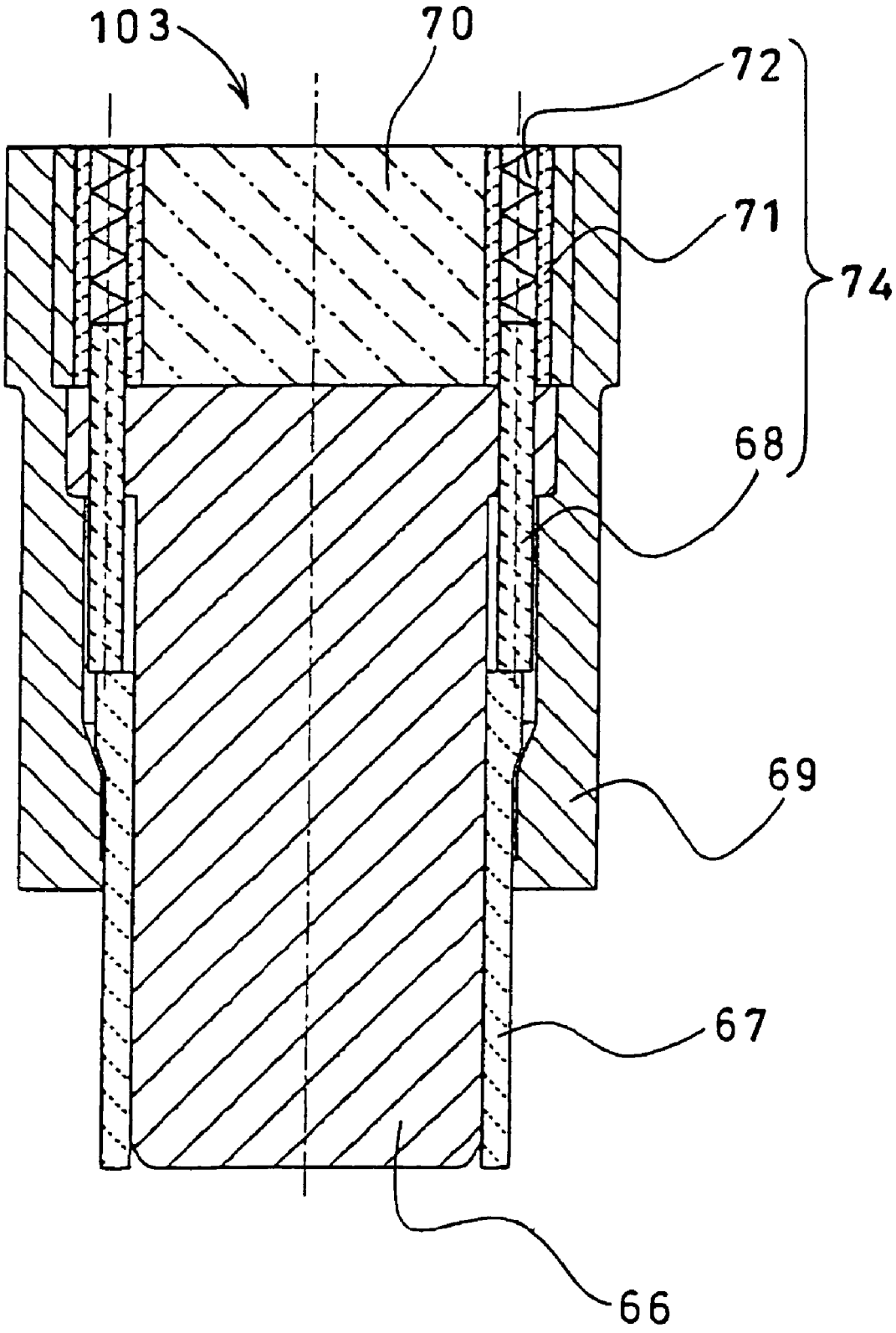
FIG. 4 is a sectional view showing the structure of an upper die of the present invention for use in forming a yoke.
Figure 8:
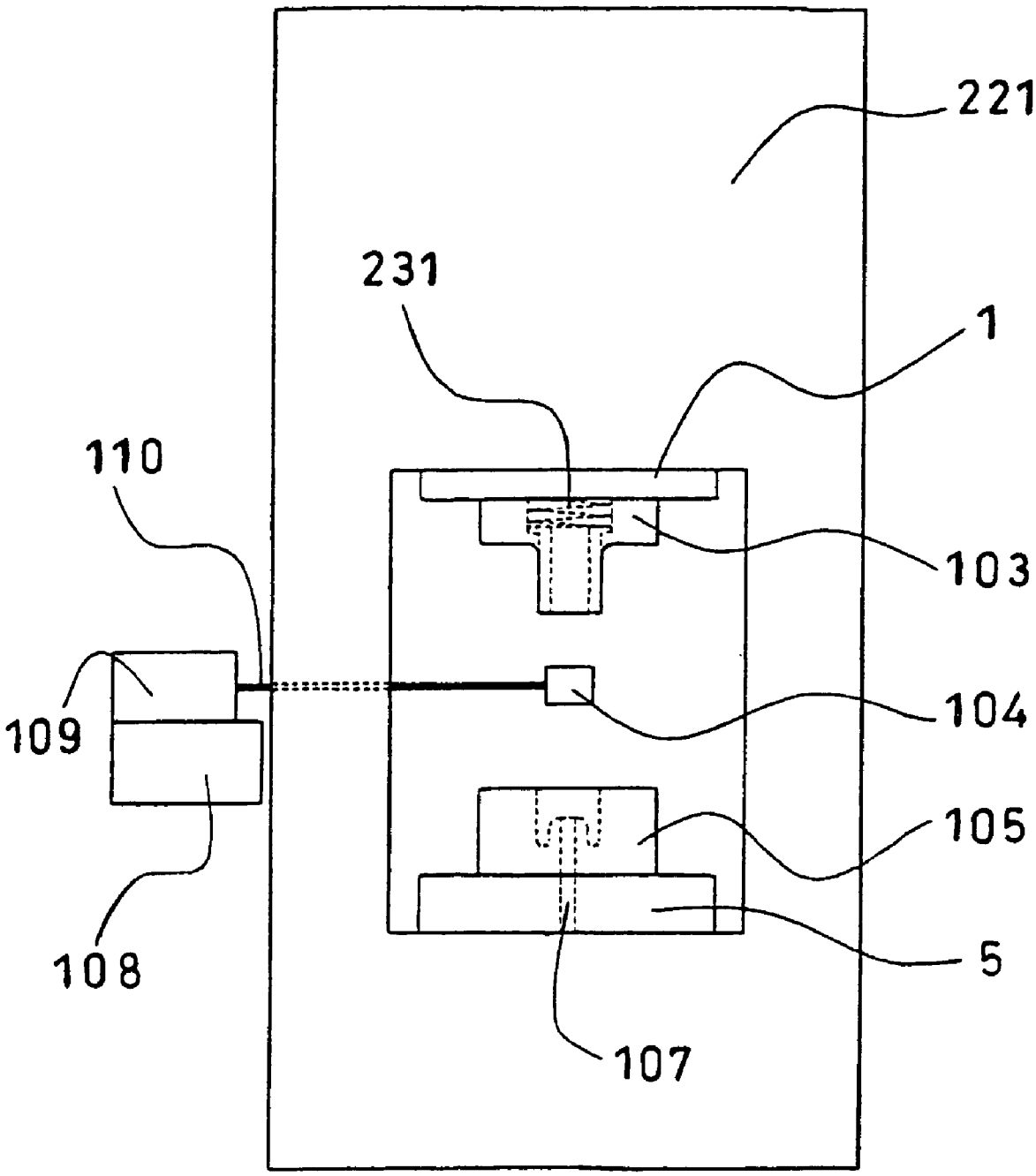
FIG. 8 is a schematic representation showing the configuration of a forging apparatus used in the present invention.

FIG. 4 is a schematic sectional view showing an example of the upper die 103 of the forging apparatus shown in FIG. 8. The upper die 103 includes a center punch 66 for forming the interior shape of a cup portion, a knock ring 67 for forming a cup portion end through application of back pressure, a gas cushion 74 serving as means for generating the back pressure, a pressure-bearing plate 70 that supports the center punch 66 and a punch holder 69 that supports the center punch 66 etc. and is fixedly attached to an upper bolster 1. The gas cushion 74 can be composed of, for example, pneumatic cylinder pressure transmission spindles 68, pneumatic cylinders 71 and pneumatic cylinder gas confinement sections 72. The ring knock 67 is subjected to the back pressure which is transmitted from the pneumatic cylinders 71 via the pneumatic cylinder pressure transmission spindles 68. Therefore, upon subjection to a force greater than a pneumatic cylinder pressure, the ring knock 67 can move rearward in relation to the upper die.

Preferably, before forming starts, the back pressure generated by the pneumatic cylinders causes the ring knock to be positioned such that the end face of the ring knock is aligned with or projects beyond the end face of the center punch adapted to form the interior shape of the cup portion. If the ring knock end is retracted from the center punch end face, a back pressure effect is not yielded as expected. Through the end face of the ring knock being aligned with or projecting beyond the end face of the center punch, the center punch is fitted into the lower die, thereby enhancing positioning accuracy.

The inner pressure of the pneumatic cylinder gas confinement sections 72 or the number of the pneumatic cylinders is adjusted such that the pneumatic cylinders impose back pressure of 0.5 to 20 kg/mm$^2$ on the ring knock. The inner pressure or the number of the pneumatic cylinders is adjusted such that, after workpiece material occupies a pin-boss-forming cavity at a filling rate of not less than 75%, the ring knock is moved in the direction opposite the regular forming direction of the upper or lower die in which the ring knock is disposed.

The gas cushion, which serves as back pressure generation means, is incorporated in the upper die in the embodiment of FIG. 4. According to the die configuration of the present invention, the gas cushion is disposed such that one end thereof is fixed on the upper bolster, and adapted to transmit stress to the ring knock via the pressure transmission spindles. In addition to the pneumatic cylinder pressure transmission spindle, examples of a pressure transmission spindle include a knockout pin and a knockout block.

No particular limitation is imposed on the back pressure generation means so long as the means can generate pressure over the entire stroke of die movement during the course of forming. In addition to the gas cushion, examples of back pressure generation means include a hydraulic cushion, a spring, a coil spring and a rubber member.

A gas cushion, when used as back pressure generation means, can provide sufficient back pressure without feed of pressure from the outside and can be incorporated into a die. Thus, use of the gas cushion allows elimination of a pressure generation unit, which would otherwise be attached to a press, and does not require a die set equipped with dedicated pressure transmission piping. Therefore, the gas cushion can be readily attached to a general-purpose press or die set. When a spring, a coil spring or a rubber member is used as back pressure generation means, the similar effect can be yielded.

A gas cushion, when used as a back pressure generation unit, exhibits excellent durability to repeated expansions and contractions and provides a wide range of sizes and stroke lengths to allow adequate selection according to applications.

Preferably, a back pressure generation mechanism is a spring, a coil spring or a rubber member. Since component parts of many types and sizes are available for such a back pressure generation mechanism, the range of choice of a die structure is expanded, and the cost of the back pressure generation mechanism is reduced.

Examples of material for the ring knock 67 include die steel and powder high-speed steel. Examples of materials for die component members include die steel, powder high-speed steel and cemented carbide. Preferably, in order to ensure the sliding operation between the ring knock and the upper die and that between the ring knock and the lower die, die surfaces on which the ring knock slides are nitrided or coated with molybdenum. Such die surfaces are, for example, an outer surface of the upper die that is adapted to form the inner wall of the cup portion and an inner surface of the lower die that is adapted to form the outer wall of the cup portion. The clearance between the ring knock and the upper die and that between the ring knock and the lower die are preferably about 0.05 to 0.3 mm. When the clearance is not greater than 0.05 mm, smooth sliding cannot be attained, and application of lubricant becomes difficult. A clearance not less than 0.3 mm is favorable in terms of sliding and application of lubricant, but raises a problem of flash formed in the clearance.

Figure 1:
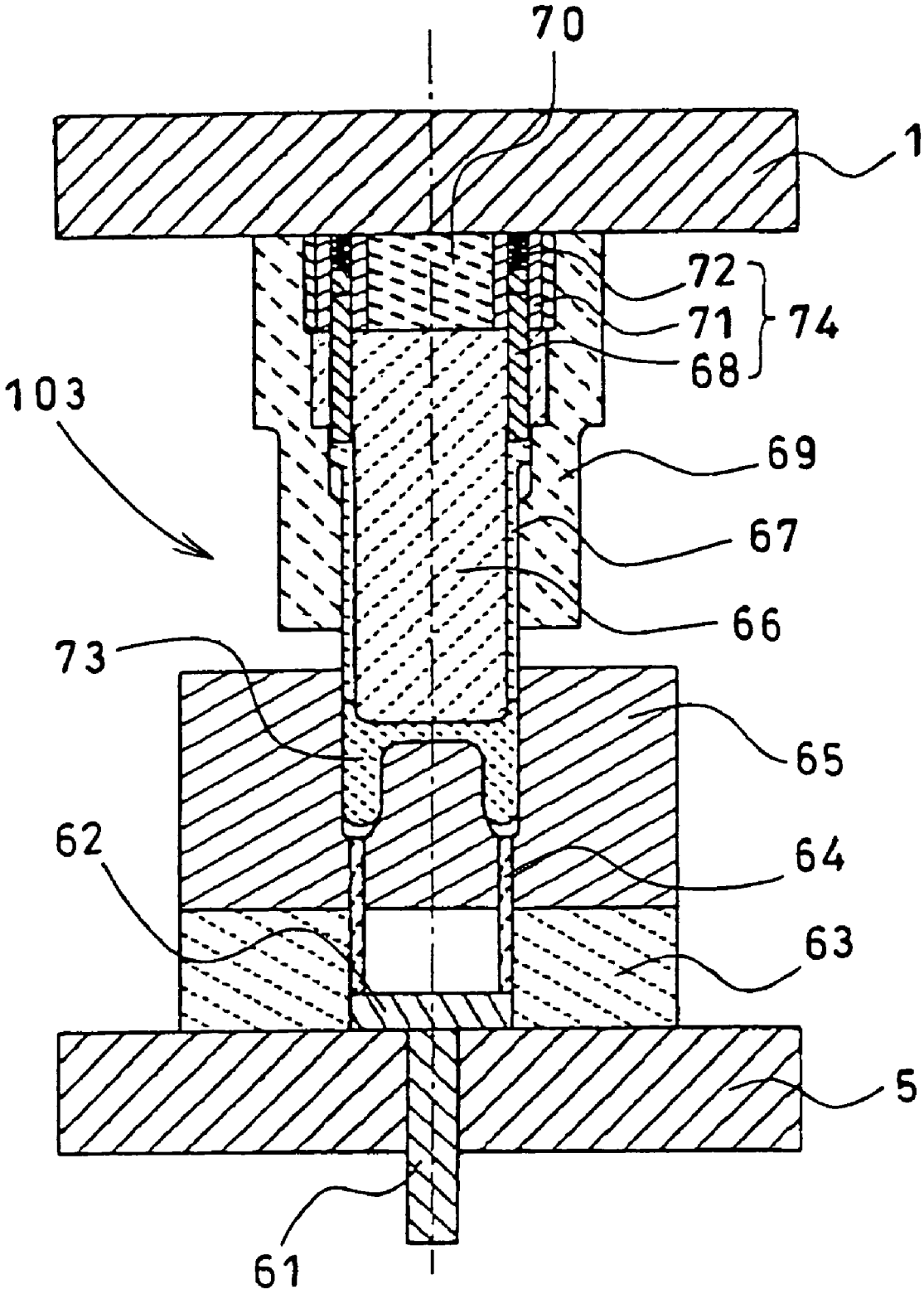
FIG. 1 is a sectional view showing a yoke-forging step of the present invention as viewed in the middle of a forging stroke.
Figure 2:
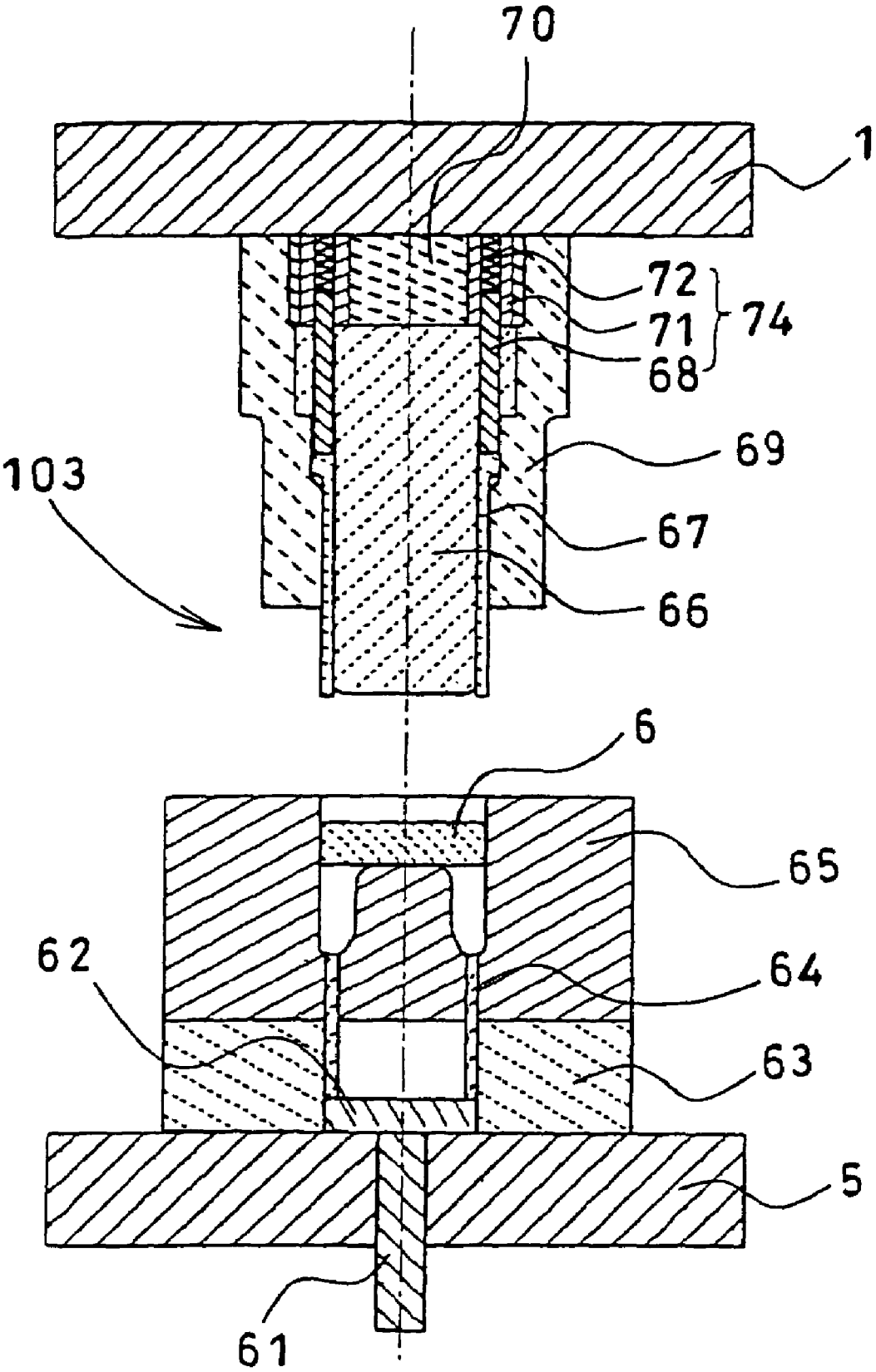
FIG. 2 is a sectional view showing the yoke-forging step of the present invention as viewed when the forging stroke is at the bottom dead center.
Figure 3:
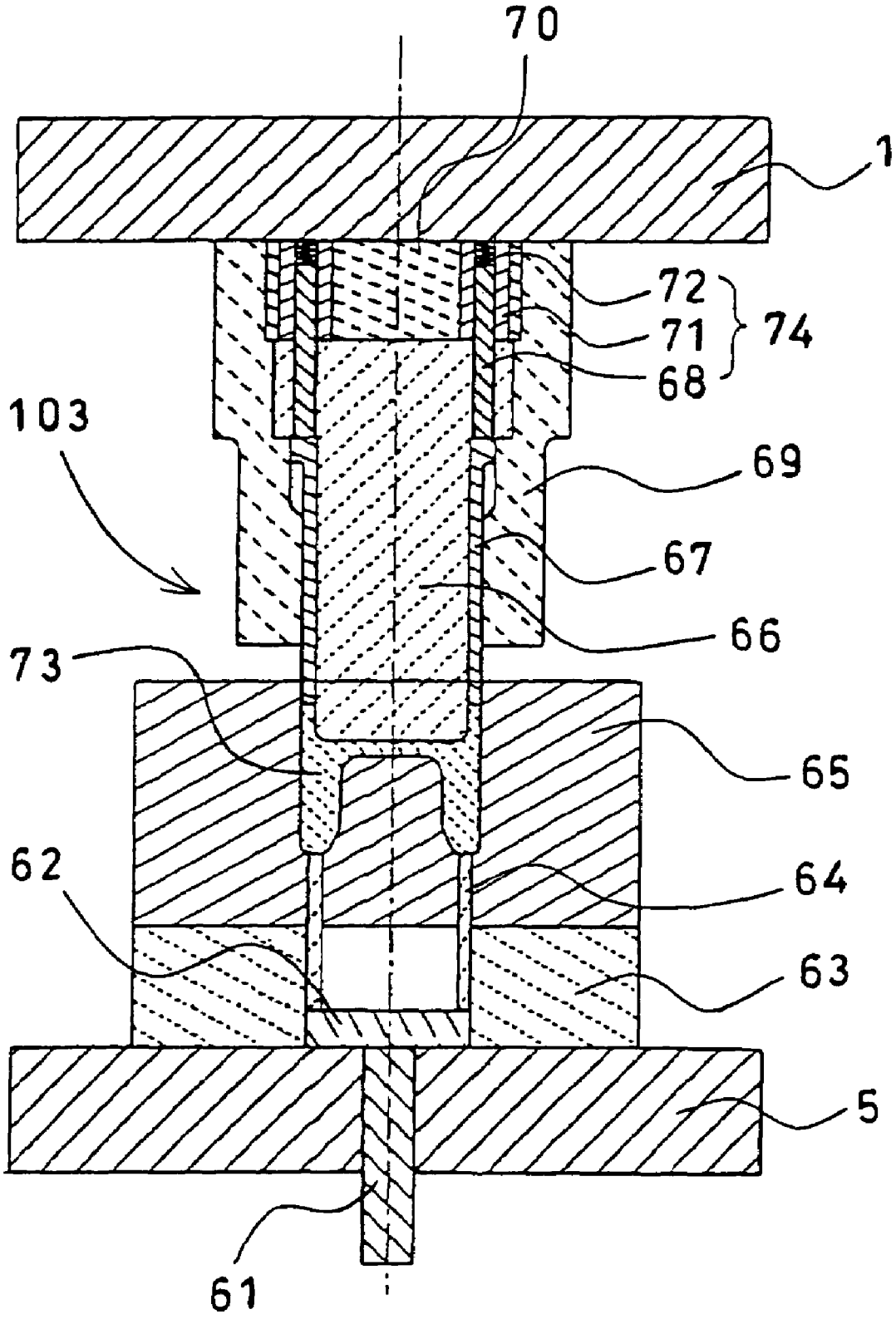
FIG. 3 is a sectional view showing the yoke-forging step of the present invention as viewed when the forging stroke is at the top dead center.

FIGS. 1, 2 and 3 schematically show forging operations and a die for use in a manufacturing method according to an embodiment of the present invention. The forging process will next be described sequentially.

As shown in FIG. 2, a workpiece to be forged is placed in the lower die 65. Then, as shown in FIG. 1, the upper die 103 descends. The ring knock 67, which partially constitutes the upper die, is first fitted into the lower die 65, thereby ensuring that the upper die and the lower die are coaxially aligned.

Figure 9:
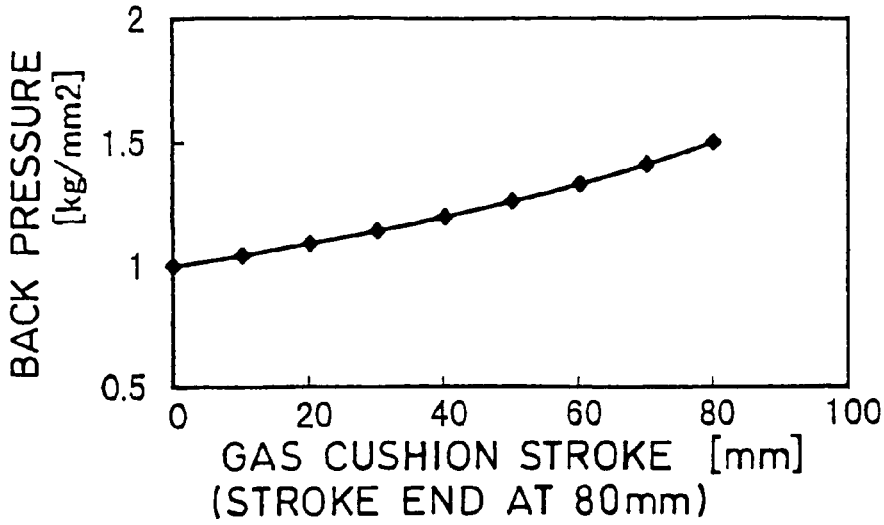
FIG. 9 is a diagram showing an example of back pressure generation means used in the present invention.

As the upper die descends further, the workpiece is held within a closed space that is defined by the upper and lower dies. At the initial stage of forming, material of the workpiece undergoes plastic flow mainly toward a pin-boss-forming cavity. The ring knock 67 of the upper die is subjected to the back pressure imposed by the pneumatic cylinder 71 and thus restricts plastic flow of the workpiece material toward a cup-forming cavity. At this time, back pressure not less than 0.5 kg/mm$^2$ is imposed on an end of a prospective cup portion of a workpiece via the ring knock 67. After the workpiece material occupies a pin-boss-forming cavity at a filling rate of not less than 75%, the ring knock moves rearward. As the contraction of a pneumatic cylinder proceeds, the pressure of the pneumatic cylinder increases. Also, as the upper die approaches the bottom dead center of the press, the forming load (the pressure imposed in the descending direction of the upper die) increases. Therefore, while appropriately maintaining the balance between the pneumatic cylinder pressure and the forming load and imposing a load on the workpiece material, the ring knock 67 retreats in the direction opposite the moving direction of the upper die. FIG. 9 shows the relationship between a ring knock stroke and the back pressure.

In the case where a pneumatic cylinder is used to generate back pressure, the initial pressure as measured when the ring knock comes into contact with a workpiece and begins to impose a load on the workpiece can be set by means of the inner pressure of the pneumatic cylinder. Subsequently, the contraction of the cylinder causes an increase in the inner pressure, and thus the load pressure increases toward the stroke end of the cylinder. The increasing load pressure functions to adjust the cup portion end to uniform height.

In the case where a spring is used to generate back pressure, the back pressure assumes the minimum value (e.g., 1 kg/cm$^2$) when the ring knock comes into contact with a workpiece and begins to impose a load on the workpiece. This is because the spring has been in an expanded state at that time. Subsequently, the contraction of the spring causes an increase in the resilient force of the spring, and thus load pressure increases to, for example, approximately 1.5 kg/cm$^2$ toward the stroke end of the spring. The increasing load pressure functions to adjust the cup portion end to uniform height.

In the present embodiment, the timing of moving the ring knock after workpiece material occupies a pin-boss-forming cavity at a filling rate of not less than 75% is adjusted beforehand by means of back pressure. However, the timing may be adjusted by means of press stroke position control or timer control.

When workpiece material occupies the pin-boss-forming cavity at a filling rate of not less than 75%, an end portion of a prospective pin boss portion comes into contact with the die surface, and the corner radius R (the radius of curvature of the corner) of the prospective pin boss portion is 8 to 15 mm. When the die cavity is completely filled with workpiece material so that the die shape is transferred to the workpiece, the corner radius R assumes a value of, for example, 5 mm. The filling rate is defined as (the volume of workpiece material occupying the pin-boss-forming cavity/the volume of the pin-boss-forming cavity of the die)×100(%).

When forming proceeds to such a state that the pin-boss-forming boss-forming cavity is substantially filled with workpiece material, the upper die 103 still continues descending, and forming pressure becomes greater than the pressure that is imposed on the ring knock 67 of the upper die by the pneumatic cylinder 71. Therefore, the ring knock retreats to the upper end of its stroke, and thus, as shown in FIG. 3, the cup-forming cavity is also filled with the workpiece material. In the case where back pressure is generated by a gas cushion, as the ring knock 67 retreats, the back pressure transmitted from a pneumatic cylinder 74 increases up to 120% to 220% of the initial back pressure. As a result of this increase of back pressure, while the cup-forming cavity is being filled with the workpiece material, an unfilled portion of the pin-boss-forming cavity is filled with the workpiece material, whereby forming is completed. This back pressure increase accelerates the forming of the cup portion and the filling of the unfilled portion of the pin-boss-forming cavity. Since high back pressure is imposed on the cup end at the time of completion of forming, a height variation of the cup end reduces.

Preferably, the stroke end position of the cylinder of the back pressure generation unit is set slightly above the bottom dead center of the press, whereby potential damage to the cylinder can be avoided.

Since the manufacturing method of the present invention uses the above-described die, back pressure not lower than 0.5 kg/mm$^2$ (back pressure of 1 to 5 kg/mm$^2$ is preferred for hot forging, and back pressure of 10 to 15 kg/mm$^2$ is preferred for cold forging) is imposed on a workpiece via the ring knock.

Figure 11:
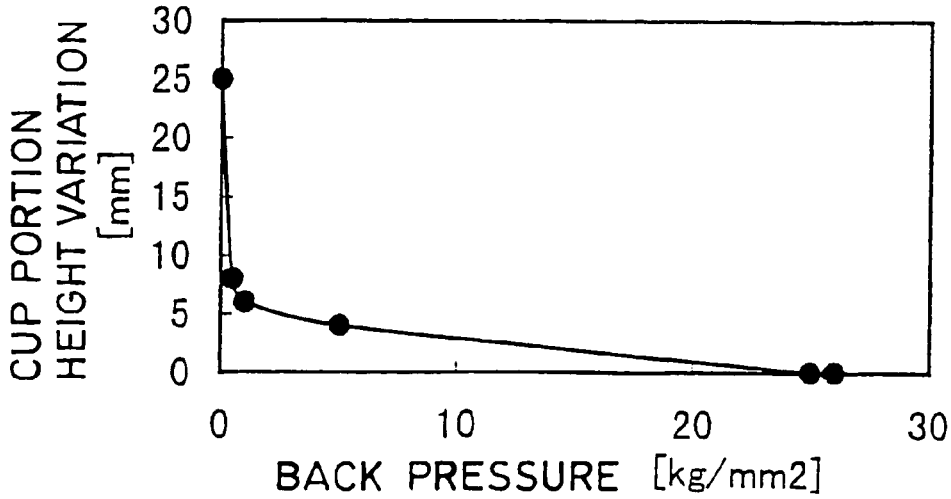
FIG. 11 is a diagram showing the relationship between back pressure generation means used in the present invention and a height variation of a cup portion.

Back pressure of 0.5 to 20 kg/mm$^2$ is preferred for the following reason. When the back pressure imposed on an end of a prospective cup portion is less than 0.5 kg/mm$^2$, the flow of workpiece material becomes non-uniform, and thus the amount of the material flowing to a cup-forming cavity varies depending on positions. As a result, the height of an end of an as-formed cup portion becomes non-uniform. FIG. 11 shows the relationship between the height variation and the lowest back pressure. When the back pressure exceeds 20 kg/mm$^2$, the flow of workpiece material to the cup-forming cavity is excessively restricted. As a result, the workpiece material fails to reach a target height in the cup-forming cavity, and a reaction force may cause an as-formed cup portion to be deformed (buckled).

When the die cavity is completely filled with workpiece material to thereby complete forming, the upper die ascends and, at the same time, the inner pressure of the pneumatic cylinder disposed in the upper die causes the ring knock 64 to press down an upper end of a cup portion of an as-forged article, thereby removing the article from the upper die. The ring knock having a back pressure generation mechanism also has an as-forged article ejection function. The ring knock can prevent adhesion of an as-forged article to a punch, which would otherwise tend to arise when the punch is used to form the cup portion. Denoted by reference numeral 62 is a knockout block.

After the upper die has ascended, a knockout pin ascends from underneath the lower die to push up the as-forged article to the top surface of the lower die, whereby the as-forged article is ejected from the die.

Next will be described an embodiment in which the initial back pressure is increased so as to increase the filling rate of the pin-boss-forming cavity, and subsequent forming is carried out while the back pressure is held lower than the initial pressure. This embodiment allows the reduction of forming load during the course of forming the cup portion, thereby enhancing the service life of the die.

The present embodiment employs, for example, a hydraulic cushion as back pressure generation means. The hydraulic cushion may be configured in a manner similar to that of the previously described pneumatic cylinder. However, oil is used in place of air.

Preferably, the initial back pressure is 1.5 to 25 kg/mm$^2$, and the back pressure during the course of subsequent forming assumes a value of 0.5 to 20 kg/mm$^2$ that is lower than the initial value.

Figure 10:
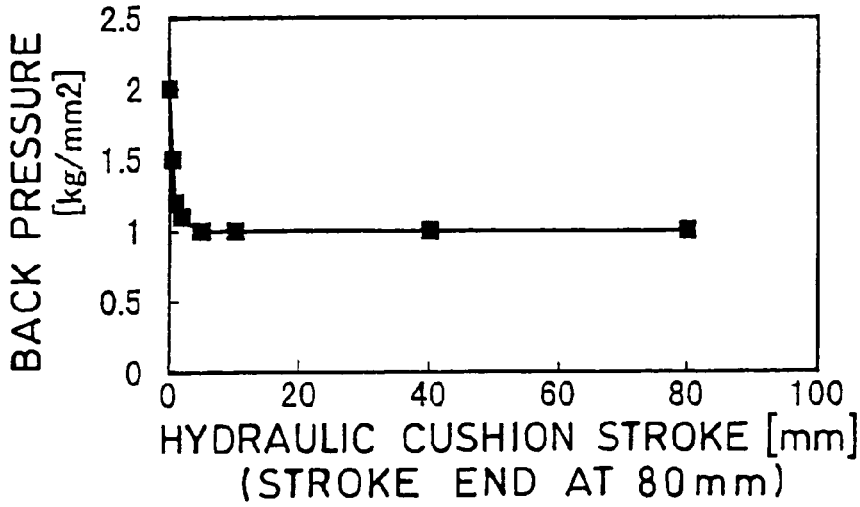
FIG. 10 is a diagram showing another example of back pressure generation means used in the present invention.

In the case where the back pressure is hydraulically generated, as shown in FIG. 10, the initial back pressure as measured when the ring knock comes into contact with a workpiece and begins to impose load on the workpiece (when a hydraulic cylinder begins to contract) is high, and the subsequent back pressure can be maintained at a constant value of not lower than 0.5 kg/mm$^2$ over a period of time ranging from the start of contraction of the hydraulic cylinder to the end of forming, since the back pressure is not influenced by the stroke length of the hydraulic cylinder. Therefore, the present embodiment exhibits enhanced forming performance. For example, the hydraulic cylinder operation can be set such that the ring knock does not start retreating until the pin-boss-forming cavity is completely filled (e.g., preferably until a filling rate not less than 90% is reached), thereby avoiding the occurrence of underfill on the pin boss portion. Since the ring knock retreats while the back pressure is maintained at a constant level, the cup portion height becomes uniform.

Preferably, hydraulic control is employed so as to change pressure setting according to product types. For example, the pressure of an external hydraulic unit is controlled by means of a forming slide signal. Alternatively, the hydraulic cylinder pressure may be regulated simply by means of a pressure-reducing valve or the like.

Preferably, the back pressure is regulated in the following manner. The initial back pressure is 1.5 to 25 kg/mm$^2$, and the subsequent back pressure assumes a value of 0.5 to 20 kg/mm$^2$ that is lower than the initial value. For example, the back pressure is 5 kg/mm$^2$ at a press angle range of 90° to 120°, the back pressure is decreased to 3 kg/mm$^2$ over a press angle range of 120° to 160°, and the back pressure is maintained at 3 kg/mm$^2$ over a press angle range of 160° to 180° so as to prevent potential buckling at the time of knockout. In order to change the back pressure from 5 kg/mm$^2$ to 3 kg/mm$^2$, two parallel hydraulic lines of 3 kg/mm$^2$ and 2 kg/mm$^2$ are operated such that a 120° signal causes the 2 kg/mm$^2$ line to be drained.

The pressure control may be combined with the aforementioned back pressure generation means so as to change pressure patterns, thereby providing load patterns to choose according to product types.

In a combination of a gas cylinder and a hydraulic cylinder, when the initial back pressure is set to be high and the subsequent back pressure is set to be lower than the initial back pressure, high back pressure can be obtained again at the termination of the forging. In this case, since the filling rate for the pin boss portion can be made higher, the forming load can be made low, and since the back pressure is high at the forging termination, the variation at the top of the cup portion can be made small. This is therefore preferable.

While the pressure of pushing out a forged product is small in the case of using a hydraulic cylinder alone, it can be made large when combined with a gas cylinder. As a result, the speed of taking out the forged product can be made higher to enhance the productivity.

A hydraulic cushion serving as a back pressure generation unit can generate an initial pressure higher than the pressure of charged oil by virtue of the flow resistance of oil. The hydraulic cushion exhibits excellent durability to repeated expansions and contractions and provides a wide range of sizes and cushion stroke lengths to allow adequate selection according to applications. The hydraulic cushion is compact and thus can be readily disposed within a die.

Figure 7:
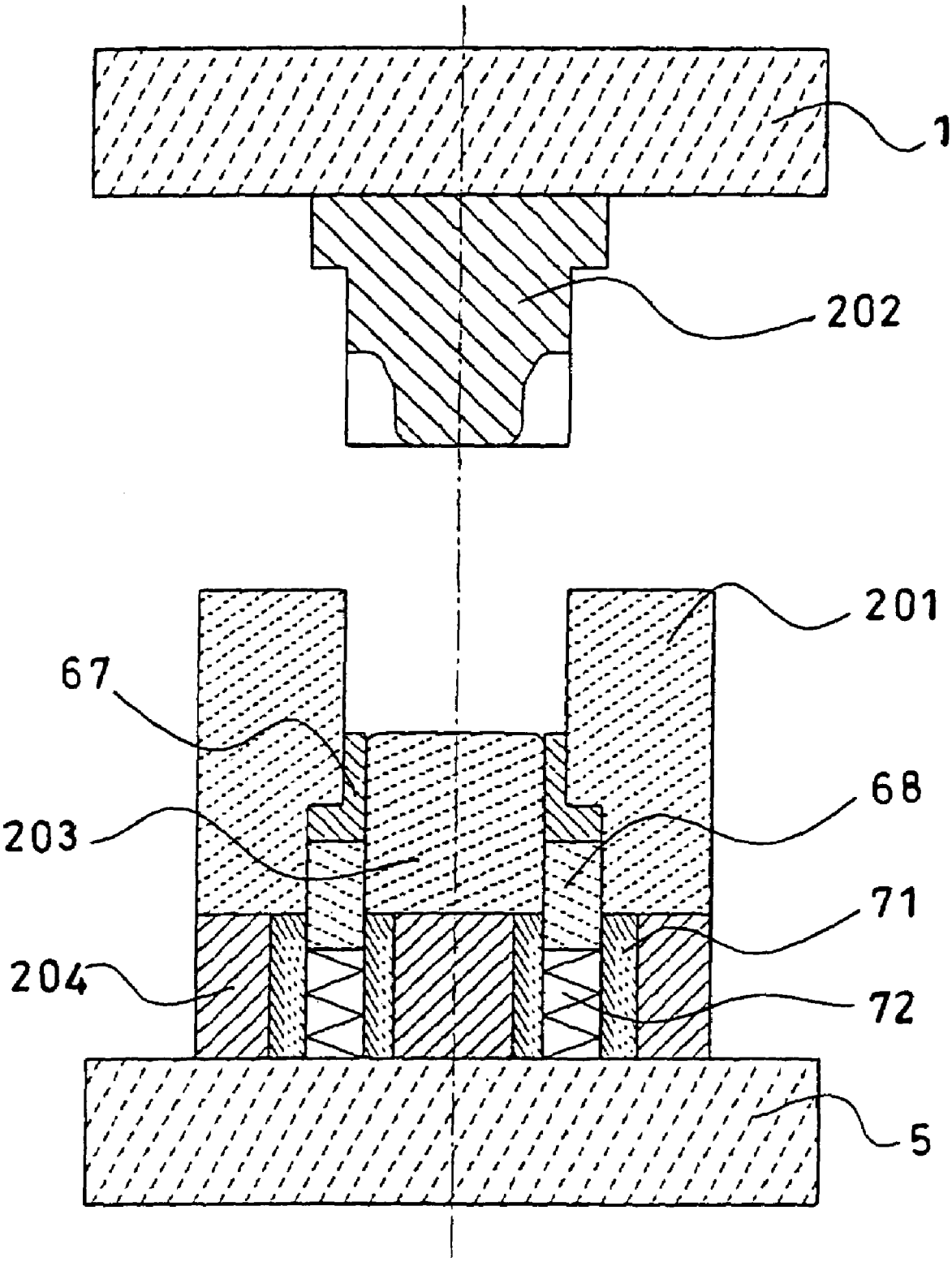
FIG. 7 is a sectional view showing a die configuration in which a movable ram is disposed in a lower die of the present invention.

The above-described die has the ring knock incorporated in the upper die. However, the ring knock may be incorporated in the lower die or in each of the upper and lower dies 202 and 201. FIG. 7 shows a die configuration in which the ring knock 67 is incorporated in the lower die, and means for generating back pressure comprises an air pressure cylinder pressure-transmitting shaft 68, an air pressure cylinder 71 and an air pressure cylinder gas confinement section 72.

An upper die that has incorporated therein a ring knock for forming a thin-walled cup portion has the following advantage. Since the direction of workpiece material flow in a cup-forming cavity is opposite the pressing direction of the upper die, the frictional resistance between the workpiece material and the die decreases, and thus the forming load decreases.

The die of the present invention is a forging die for use in forging a universal joint yoke preform and includes an upper die and a lower die, which define a closed space, a ring knock, a knockout pin, a die holder, back pressure generation means for generating a back pressure not lower than 0.5 kg/mm$^2$ to be applied to the ring knock, and a pressure-bearing plate on which the upper or lower die and the back pressure generation means are disposed. Thus, the die of the present invention is applicable to such a case where a conventional large-sized back pressure apparatus cannot be disposed since a forging press stroke is short and a spacing between die sets is narrow. Since the die of the invention is applicable to a small-sized forging apparatus, the cost of equipment can be reduced.

Figure 17:
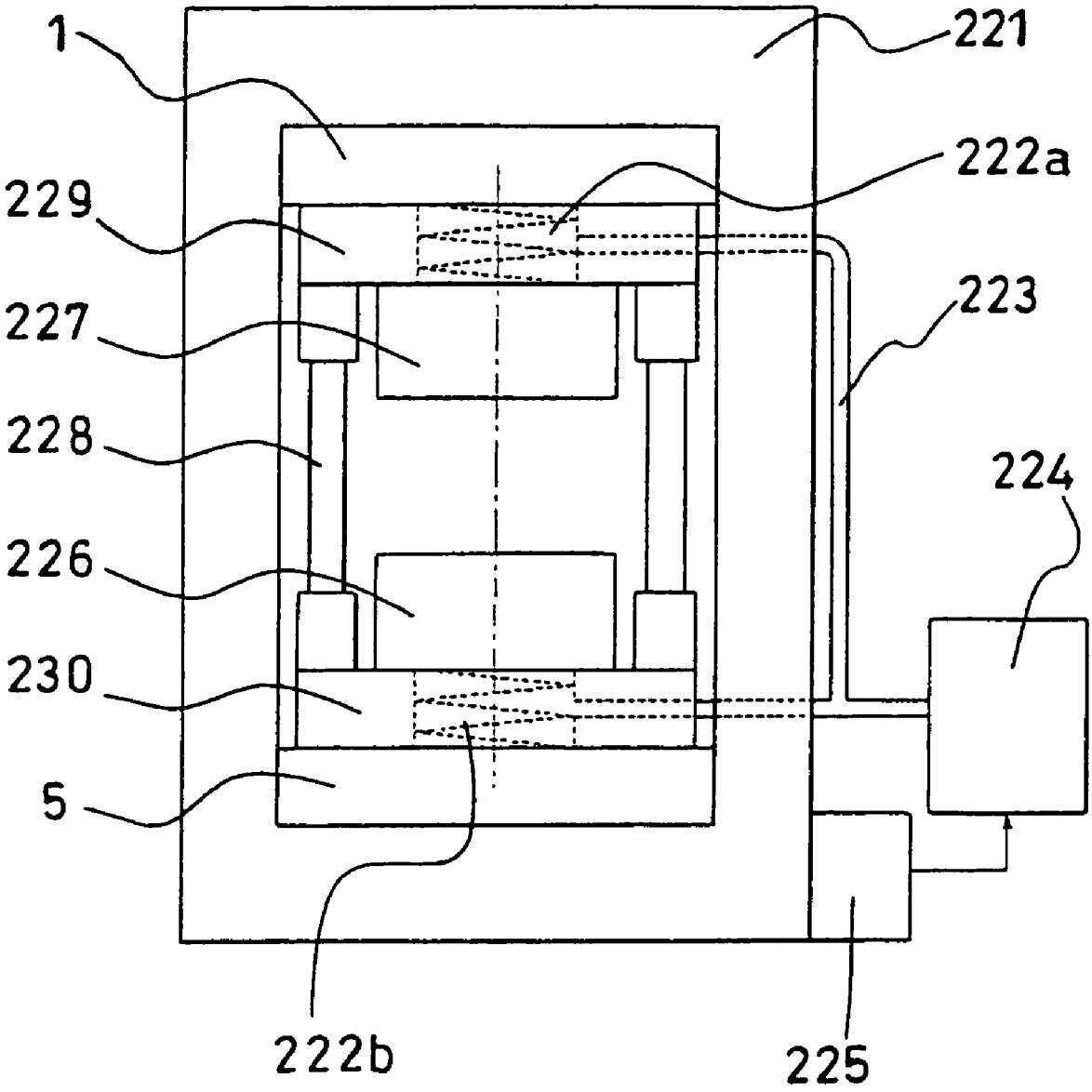
FIG. 17 is a schematic representation showing a forging machine equipped with a conventional back pressure apparatus, and a die set.

FIG. 17 shows a forging press configuration in which a conventional back pressure apparatus is disposed. A die set equipped with an upper die 227 and a lower die 226 is attached to the forging press 221. The die set comprises an upper plate 229, a lower plate 230 and a guide rod 228. The upper and lower dies 229 and 230 are provided with hydraulic cylinders 222*a* and 222*b* for transmitting back pressure to the upper and lower dies. The forging press has to be equipped with a hydraulic pressure generation unit 224, hydraulic piping 223, a press operation monitoring unit 225 for monitoring press operations and generating an electric signal to instruct the hydraulic pressure generation unit 224 to generate hydraulic pressure at the timing when back pressure is required, and others. Further, the forging press must have a wide space between an upper ram 1 and a lower bolster plate 5.

The die of the present invention is configured such that a compact back pressure generation mechanism is incorporated in the upper die and/or the lower die. Therefore, while a conventional die set is used intact, a conventional die may merely be replaced with the die of the present invention, whereby an as-forged article having a cup portion of uniform height can readily be obtained by means of a mechanism that imposes stress in the direction opposite the regular forming direction.

A method for manufacturing a universal joint yoke preform by use of the die of the present invention performs forging such that, while a back pressure not lower than 0.5 $kg/mm^2$ is applied to an end of a prospective universal joint yoke cup portion of a workpiece via a ring knock, the material of a workpiece is allowed to flow into a pin-boss-forming cavity adapted to form a pin boss portion extending opposite the prospective cup portion until a filling rate not lower than 75% is reached, and that the ring knock is then moved in the direction opposite the regular forming direction of the upper or lower die in which the ring knock is disposed so as to initiate the flow of workpiece material toward the prospective cup portion.

As a result, the flow of the workpiece material toward the prospective cup portion can be sufficiently suppressed such that the workpiece material can flow into the pin-boss-forming cavity in precedence to a cup-forming cavity until a filling rate not less than 75% is reached. Subsequently, at a point of time when the influence of a material flow toward the pin-boss-forming cavity on a material flow toward the cup-forming cavity diminishes, the flow of the workpiece material toward the cup-forming cavity can be initiated, whereby underfill on an end region of an as-formed cup portion can be suppressed to a small degree.

Therefore, in the produced yoke preform, the difference between the maximum and minimum heights of the cup portion, i.e. the height variation, falls within 8 mm. Since this height variation is less than the preferred value of 10 mm, a cutting step of making the height uniform is not required after the forging step. In the case where it is necessary to perform cutting to finish a stepped part of a cup portion end against which a shaft to be inserted on the stepped part and joined to the cup portion collides, a cutting allowance is to be set in consideration of possible variation in height of the cup portion. In the present invention, however, since the height variation falls within 8 mm, the cutting allowance can be reduced, resulting in a short time required for cutting and in high productivity.

In addition, in the plastic flow trace observed at the cross section viewed in the vertical direction of the cup portion of the yoke preform (from the distal end to the proximal end of the cup portion), the ratio of the crystal grain average length as measured at parts 41*b* to a crystal grain average length as measured at parts 41*a* is 0.5 to 1.5, wherein the parts 41*a* are in an end region of the cup portion, opposite to which no pin boss portion exists, and the parts 41*b* are in an end region of the cup portion, opposite to which the pin boss portion exists. Therefore, the preform has uniform mechanical strength that is preferable from the standpoints of machining and practical use.

Figure 16A:
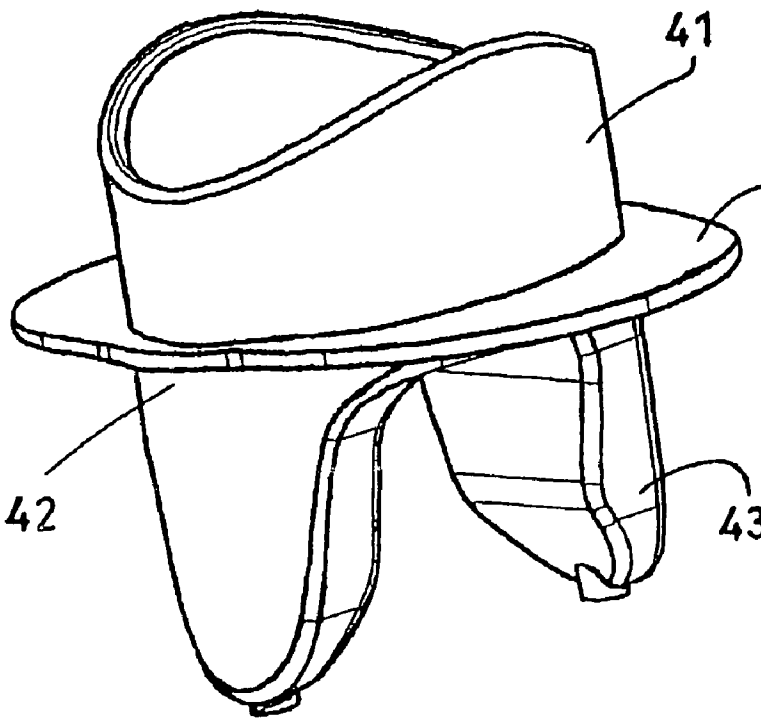
FIG. 16(*a*) is a perspective view showing an as-forged preform obtained by a conventional flash-emerging forging process and FIG. 16(*b*) is a perspective view showing a perform obtained by trimming the perform of FIG. 16(*a*).
Figure 16B:
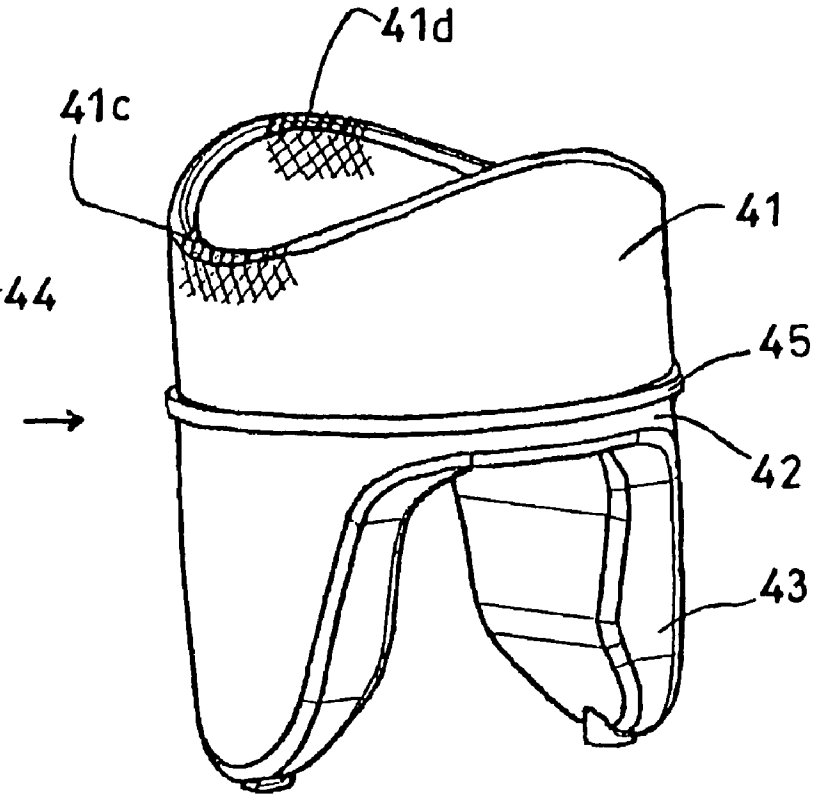
PRIOR ART FIG. 16(b)

Furthermore, since the clearance between the ring knock and the upper die and that between the ring knock and the lower die are set at about 0.05 to 0.3 mm, the perform obtained has no flash at the parting-line portion (corresponding to the portion 44 in FIG. 16 showing the prior art). Since no flash emerges, plastic flow in the flash direction does not occur. Therefore, mechanical strength at the parting-line portion is high. Thus, flash-trimming operation is not required, and it is possible to avoid a decrease by flash formation in yield in terms of material utilization.

Next will be described an embodiment of the method of the present invention for manufacturing a universal joint yoke by use of the apparatus of FIG. 2.

The manufacturing method of the present invention includes the steps of placing a workpiece in a die, applying lubricant to the workpiece, preheating the workpiece to a predetermined temperature, applying lubricant to the die, forging the workpiece and ejecting an as-forged article (forged product: yoke preform) by means of a knockout mechanism.

Preferably, the manufacturing method further includes the pre-forging steps of cutting a round bar of aluminum alloy into pieces each having a predetermined length and upsetting each of the cut pieces to obtain forging workpieces, and the post-forging steps of heat-treating an as-forged article and machining the heat-treated article without involvement of trimming.

Preferably, a yoke material for use in the manufacturing method of the present invention is an aluminum alloy. In order to meet, for example, the need for reducing the weight of automobiles, demand exists to use an aluminum alloy as material for yokes, since an aluminum alloy exhibits a high specific strength and facilitates the reduction of weight of articles, as compared with iron and brass. In a forging process, however, the material of a workpiece is moved under pressure over a relatively long distance into a die cavity so as to fill the cavity. When the workpiece is of an aluminum alloy, the forging process encounters difficulty in filling the die cavity with the workpiece material, since, even at high temperature, the aluminum alloy exhibits low ductility/malleability and thus high deformation resistance. Therefore, a conventional single-stage forging process, which is intended to forge brass or a like material and attains a plastic working rate not lower than 70% through utilization of high ductility of such material at high temperature, encounters difficulty, when used to forge an aluminum alloy article, in obtaining underfill-free good quality through sufficient filling of a die cavity with workpiece material. In the present invention, the forging step is performed such that, while a back pressure not lower than 0.5 $kg/mm^2$ is applied to an end of a prospective universal joint yoke cup portion of a workpiece via a ring knock, the material of the workpiece is allowed to flow into a pin-boss-forming cavity adapted to form a pin boss portion extending opposite the prospective cup portion until a filling rate not lower than 75% is reached, and that the ring knock is then moved in the direction opposite the regular forming direction of the upper or lower die in which the ring knock is disposed so as to initiate the flow of workpiece material toward the prospective cup portion. Therefore, underfill-free good quality can be obtained through sufficient filling of a die cavity with the workpiece material.

Examples of materials having favorable corrosion resistance, favorable high-temperature strength and high elasticity include A6061, A6082, A2014, A2218, A4032 and A7075 of JIS. A preferable material is aluminum alloy having a composition of Al, 0.4% to 0.8% by mass of Si, 0.15% to 0.40% by mass of Cu, 0.8% to 1.2% by mass of Mg and 0.04% to 0.35% by mass of Cr. A6061 and A6082 have balanced characteristics, specifically excellent corrosion resistance, excellent anodic oxidation and medium strength. A2014 and A2218 have high strength and high elasticity and are thus favorably used as materials for heavy-load yokes, since the strength of the yokes is enhanced. A4032 has excellent wear resistance and high elasticity and is thus favorably used as a material for yokes which must be resistant to wear associated with sliding on a cross member, since the wear resistance of the yokes is enhanced. A7075 exhibits the highest strength among aluminum alloys of practical use and is thus favorably used as a material for yokes that must have as high strength as that of iron, since the strength of the yokes is enhanced to the required level. Among alloys of practical use, aluminum alloys are light and exhibit excellent toughness. Among these aluminum alloys, A6061, which has medium strength and excellent corrosion resistance, is favorably used as a material for yokes. Favorable materials for yokes that must have high strength are 2000-series aluminum alloys that are Al—Cu alloys, and 7000-series aluminum alloys that are Al—Zn alloys. The Al—Cu and Al—Zn alloys have as high strength as that of iron. 4000-series aluminum alloys that are Al—Si alloys and have excellent wear resistance are favorably used as materials for other parts (such as cross members) which involve a potential problem of wear associated with contact with other parts.

A round bar of aluminum alloy is formed through extrusion or continuous casting. The thus obtained round bar of aluminum alloy is cut into pieces each having a predetermined length. These pieces are upset into forging workpieces.

A round aluminum bar having a diameter smaller than the outside diameter of a product is cut into pieces each having such a length that the volume of the piece is equivalent to that of the product. Each of the cut pieces is upset to assume a diameter that is 0.5 to 5 mm smaller than the outside diameter of the product. The thus upset pieces are formed into yokes through forging. In sawing a round bar, the material of the round bar is wasted in the form of cutting chips, which are portions of the round bar cut away by a saw and each have a width equivalent to the thickness of the saw. Therefore, use of a round bar of a small diameter is preferred, since high yield in terms of material utilization is attained. Further, the upsetting process enhances the ductility of workpieces. Because of subjection to repeated load, yokes must have good toughness. The enhancement of ductility leads to the enhancement of toughness. A width variation among cutout portions of a bar during the course of sawing less influences a volume variation among cut pieces in cutting a small-diameter bar than in cutting a large-diameter bar. Thus, use of a small-diameter bar leads to a reduction in the degree of overload on a die during the course of forging.

As shown in FIG. 2, a forging workpiece is placed in the lower die 65 of the forging apparatus having the aforementioned dies. Forging workpieces may be obtained by, for example, cutting a continuously cast bar into pieces each having a predetermined length. The workpieces are lubricated beforehand as needed. Examples of lubrication processes for workpieces include Bonderite treatment and the application of an aqueous graphite lubricant through immersion in the lubricant. In the case where a workpiece undergoes intensive plastic working at such a high plastic working rate that the base aluminum is exposed with resultant exposure of a fresh surface of a silver metal gloss, Bonderite treatment is preferred in order to prevent lubrication failure. In the case of forming a product having an outside diameter not less than 90 mm, a workpiece may be upset beforehand in order to assume a relevant large diameter.

Before being placed in a die, a workpiece is preheated to a temperature of, for example, 370° C. to 550° C.

Lubricant is applied to the die. Lubricant to be used is an aqueous graphite lubricant or an oil-based graphite lubricant. Since lubricant is applied to the die while the ring knock is retracted in the upper die, an oil-based graphite lubricant, which is highly permeable into a clearance, is preferred. Preferably, lubricant is applied to the die in an amount of 1 to 10 g (concentration: 0.5 to 25% by mass).

Next, the forging process will be described.

First, major forging is performed. The upper die 103 descends, and a workpiece 6 is restrained between the upper and lower dies. The material of the workpiece flows into a pin-boss-forming cavity engraved in the lower die, whereby a pin boss portion is roughly formed. At this stage, a material flow is mainly directed toward the pin-boss-forming cavity, whereas a material flow is hardly directed toward a prospective cup portion of the workpiece located around the upper die, since a pneumatic cylinder pressure is imposed on the prospective cup portion via the ring knock. At this stage, distal portions of the pin-boss-forming cavity are not filled with the workpiece material.

Even after being fitted into a lower die bore, the upper die continues descending, whereby the workpiece material reaches up to the distal portions of the pin-boss-forming cavity to thereby fill the cavity. At this stage, the forming load becomes greater than the pressure of the pneumatic cylinder disposed in the upper die to thereby cause the rig knock to ascend, whereby the workpiece material begins to flow into a cup-forming cavity and then fills the cavity.

Since the upper die is fitted into the bore formed in the lower die over the period of time ranging from the start of forming to the completion of forming, the concentricity between the inner cylindrical wall of the cup portion and the outer cylindrical wall of the cup portion is not greater than 0.2 mm, which is the clearance between the upper and lower dies. Since the upper and lower dies are in a closed condition, the exterior surface of an as-forged article does not require trimming.

Forging conditions can be optimized according to product shapes. For example, forging conditions are set at a press speed of 10 to 40 spm, back pressure of 0.5 to 20 kg/mm$^2$ imposed on the ring knock and a workpiece temperature of 200° C. or higher (solidus temperature of −20° C.).

The die is heated beforehand to a temperature of 100° C. to 400° C.

After forging is completed, an as-forged article is ejected by means of the knockout pin.

The as-forged article is preferably heat-treated. The heat treatment is intended to enhance the mechanical strength of a forged preform and performed in the following manner.

The as-forged article is allowed to stand at a temperature of 460° C. to 560° C. for 1 to 5 hours and is then immediately immersed in a water bath (with the water temperature of 10° C. to 70° C.). Then the article is allowed to stand at a temperature of 150° C. to 250° C. for 1 to 10 hours, whereby a forged preform having a predetermined strength can be obtained.

The obtained as-forged article is a universal joint yoke preform that is manufactured in the following manner. While a back pressure not lower than 0.5 kg/mm$^2$ is applied to an end of a prospective yoke cup portion of a workpiece via a ring knock, the material of the workpiece is allowed to flow into a pin-boss-forming cavity adapted to form a pin boss portion extending opposite the prospective cup portion, until a filling rate not lower than 75% is reached. Then the ring knock is moved in the direction opposite the regular forming direction of the upper or lower die in which the ring knock is disposed, so as to initiate the flow of workpiece material toward the prospective cup portion.

The obtained as-forged article is a universal joint yoke preform in which a height variation of a cup portion thereof is suppressed to not greater than 8 mm through manufacture by use of a mechanism for imposing stress in the direction opposite the regular forming direction.

The forged article which has undergone heat treatment undergoes drilling, which is performed by use of a machining center, for drilling pinholes, and machining, which is performed by use of an NC lathe, for forming a shaft coupling portion, whereby the article is finished to a yoke.

Since a height variation of a cup portion is not greater than 8 mm, the forged article does not need to undergo machining for correcting the height variation of a cup end thereof. Therefore, there is obtained a universal joint yoke preform that does not need to undergo machining for correcting a height variation of a cup end thereof. The fact that a height variation of a cup portion is not greater than 8 mm indicates the following: in observation of traces of plastic flow on the sections, taken along the longitudinal direction of the end regions of the cup portion of a yoke (the direction extending from the end region to the root region of the cup portion), the ratio of a crystal grain average length as measured at (41*b*) to a crystal grain average length as measured at (41*a*); i.e., (41*b*)/(41*a*), is 0.5 to 1.5, preferably 0.7 to 1.3, wherein (41*a*) is an end region of the cup portion opposite to which no pin boss portion is present, (41*b*) is an end region of the cup portion opposite to which a pin boss portion is present, and the sections are mirror-polished, etched with acid and then observed through a microscope at about 100 magnifications. Therefore, the yoke has a cup portion that is uniform in crystal grain length as observed along the circumference thereof. In the case of a yoke obtained by a conventional forging process, a crystal grain average length as measured at (41*d*) is small as compared with a crystal grain length as measured at (41*c*) , wherein (41*c*) is an end region of a cup portion opposite to which no pin boss portion is present, and (41*d*) is an end region of the cup portion opposite to which a pin boss portion is present. Specifically, the ratio of a crystal grain average length as measured at (41*c*) to a crystal grain average length as measured at (41*d*); i.e., (41*c*)/(41*d*), is not greater than 0.5, indicating that the cup portion is not uniform in crystal grain length.

The manufacturing method of the present invention implements sing-stage closed forging that replaces multi-stage forging employed in a conventional manufacturing method, thereby eliminating the need to use dies dedicated to individual stages.

According to the manufacturing method of the present invention, forming is performed while the upper and lower dies are in a closed condition. Thus, no flash is formed on the exterior surface of an as-forged article, thereby eliminating the need to perform trimming. Therefore, the manufacturing method of the present invention can manufacture a yoke that does not bear a trimming mark. Also, the manufacturing method of the present invention enhances yield in terms of material utilization. As a result, a manufactured yoke has an outer circumferential surface bearing no trimming mark and is thus favorable in terms of strength and appearance.

Examples of the present invention will be described. However, the present invention is not limited to these examples.

EXAMPLES

Yoke preforms shown in FIG. 6 were manufactured by use of the apparatus shown in FIG. 2.

The upper die of the employed dies had the ring knock incorporated therein for forming a cylindrical cup shape. In manufacture of yoke preforms of Examples and Comparative Examples, back pressure generation means and the back pressure imposed on the ring knock were changed as shown in Tables 1 and 2. In manufacture of the yoke preforms appearing in Table 1, the gas cushion was used. The results of manufacture are shown in Tables 1 and 2. The filling rate for evaluation sake was obtained in the following manner: the bottom dead center was raised to the position of starting material flow to the cup-forming cavity so as to obtain an article in process of forming, and the volume of a pin boss portion of the obtained article was divided by the volume of the pin-boss-forming cavity of the die to thereby obtain a pin-boss-forming cavity filling rate. The cup end waviness (difference in height or height variation) of the cup portion was defined as the difference between the highest position and the lowest position along the circumference of the cup portion.

A continuously cast bar of aluminum alloy A6061 having a diameter of 75 mm was sewn into pieces each having a length of 85 mm by use of a circular saw machine. The cut material pieces were heated to 450° C. and then upset by use of the upsetting die having a diameter of 115 mm, thereby obtaining forging workpieces each having a diameter of 114.3 mm and a thickness of 40 mm. A graphite lubricant was applied to the obtained forging workpieces, which were then preheated to 450° C. Each of the thus preheated workpieces was placed in the lower die. The upper die was caused to descend to start forming through loading in the axial direction. The upper die descends while being fitted into the bore of the lower die, thereby forming the pin boss portion. Subsequently, as the forming load increases, the ring knock ascends, thereby forming the cup portion. After completion of forming, an as-forged article was ejected from the die by means of the knockout mechanism.

Forging conditions included the press speed of 25 spm (strokes/minute) and the back pressure of 0 to 26 kg/mm$^2$ generated by the back pressure generation mechanism, as shown in Tables 1 and 2.

The forged articles; i.e., the yoke preforms, of the Examples exhibited little cut end waviness. Since the die structure does not allow formation of a flash at a die-parting portion of each yoke preform, yoke preforms bearing no trimming mark could be obtained without employment of a trimming process. The concentricity between the inner and outer cylindrical walls of the cup portion was 0.11 mm. Test pieces were cut out from the end regions of the cup portions of the yoke preforms of the Examples. The test pieces were mirror-polished and then etched with acid, followed by observation through the microscope at about 100 magnifications. The observation revealed that the ratio of a crystal grain average length as measured at (41*b*) to a crystal grain average length as measured at (41*a*); i.e., (41*b*)/(41*a*), was 0.5 to 1.5, wherein (41*a*) is an end region of the cup portion opposite to which no pin boss portion is present, and (41*b*) is an end region of the cup portion opposite to which the pin boss portion is present.

Test pieces were cut out from the pin boss portions of the yoke preforms of the Examples. The tension-loading test on the test pieces revealed that the tensile strength was 400 MPa, and the Young's modulus was 75 kN/mm$^2$.

TABLE 1

| | Back pressure [kg/mm$^2$] | Filling rate | Height variation of cup portion of forged article | Buckling of cup portion |
|---|---|---|---|---|
| Example 1 | 0.5 | 75% | 8 mm | Absent |
| Example 2 | 1 | 85% | 6 mm | Absent |
| Example 3 | 5 | 95% | 4 mm | Absent |
| Example 4 | 25 | 100% | 0 mm | Absent |
| Comparative Example 1 | 0 | 50% | 25 mm | Absent |
| Comparative Example 2 | 0.4 | 70% | 10 mm | Absent |
| Comparative Example 3 | 26 | 100% | 0 mm | Present |

The filling rate associated with the pin-boss-forming cavity was measured at a point in time at which the material begins to flow into the cup-forming cavity.

TABLE 2

| | Initial back pressure [kg/mm$^2$] | Back Pressure at stroke end [kg/mm$^2$] | Back pressure generation unit | Height variation of cup portion of forged article |
|---|---|---|---|---|
| Example 5 | 2 | 0.5 | Hydraulic cushion | 6 mm |
| Example 6 | 5 | 2 | Hydraulic cushion | 4 mm |
| Example 7 | 0.5 | 0.8 | Gas cushion | 8 mm |
| Example 8 | 1 | 1.5 | Gas cushion | 4 mm |

Industrial Applicability:

The manufacturing method of the present invention comprises a forging step for forming a universal joint yoke preform from a workpiece placed in a die comprising an upper die and a lower die, which define a closed space, the forging step being performed such that, while a back pressure not lower than 0.5 kg/mm$^2$ is applied to an end of a prospective universal joint yoke cup portion of the workpiece via a ring knock, material of the workpiece is allowed to flow into a pin-boss-forming cavity adapted to form a pin boss portion extending opposite the prospective cup portion until a filling rate not lower than 75% is reached, and that the ring knock is then moved in the direction opposite the regular forming direction of the upper or lower die in which the ring knock is disposed so as to initiate flow of workpiece material toward the prospective cup portion. Thus, the manufacturing method can form a yoke having a cup portion of a uniform excess-metal height while suppressing the formation of underfill or an unfilled portion, and thus can manufacture yokes whose preforms are small in quantity of cutting at high productivity, which is attained by enhanced yield in terms of material utilization and reduced man-hours.

The invention claimed is:

1. A method for manufacturing a universal joint yoke, comprising a forging step for forming a universal joint yoke preform from a workpiece placed in a die comprising an upper die 103 and a lower die 65, which are to define a closed space, the forging step being performed such that while a back pressure not lower than 0.5 kg/mm$^2$ is applied to an end of a prospective universal joint yoke cup portion of the workpiece via a ring knock 67, material of the workpiece is allowed to flow into a pin-boss-forming cavity of the lower die adapted to form a pin boss portion extending opposite the prospective cup portion until a filling rate not lower than 75% is reached, and that the ring knock is then moved in a direction opposite a regular forming direction of the upper or lower die, in which the ring knock is disposed, so as to initiate flow of the workpiece material toward the prospective cup portion.

2. The manufacturing method according to claim 1, wherein the back pressure increases as the ring knock moves in the opposite direction, and a final back pressure is 1.2 to 2.2 times an initial back pressure.

3. The manufacturing method according to claim 1 or 2, wherein the back pressure is generated by means of a gas cushion or spring.

4. The manufacturing method according to claim 1, wherein a back pressure of 1.5 to 25 kg/mm$^2$ is initially applied, and then, while the back pressure is held at a value of 0.5 to 20 kg/mm$^2$ that is lower than the initially applied value, the workpiece material is allowed to flow into the pin-boss-forming cavity until a filling rate not lower than 90% is reached, followed by movement of the ring knock.

5. The manufacturing method according to claim 1, wherein the back pressure is generated by means of a hydraulic cushion.

6. The manufacturing method according to claim 1, wherein the back pressure is generated by at least two means selected from gas cushion, spring and hydraulic cushion.

7. The manufacturing method according to claim 1, wherein the workpiece is of an aluminum alloy selected from among A6061, A6082, A2014, A2017, A4032 and A7075.

8. The manufacturing method according to claim 1, wherein the workpiece is formed by the steps of cutting a round bar of an aluminum alloy into pieces each having a predetermined length and upsetting each of the pieces, and further comprising the steps of heat-treating an as-forged article and machining the heat-treated article.

9. The manufacturing method according to claim 8, wherein the machining step to be performed after the forging step does not involve a step of trimming a parting-line flash of the as-forged article.

* * * * *